US008807915B2

(12) United States Patent
Moritsugu et al.

(10) Patent No.: US 8,807,915 B2
(45) Date of Patent: Aug. 19, 2014

(54) DOUBLE CASING TYPE PUMP AND PERFORMANCE ADJUSTING METHOD THEREOF

(75) Inventors: Takahiro Moritsugu, Tokyo (JP); Satoaki Aoki, Tokyo (JP); Hidetoshi Fukuta, Tokyo (JP)

(73) Assignee: Mitsubishi Heavy Industries, Ltd., Tokyo (JP)

( * ) Notice: Subject to any disclaimer, the term of this patent is extended or adjusted under 35 U.S.C. 154(b) by 812 days.

(21) Appl. No.: 12/914,009

(22) Filed: Oct. 28, 2010

(65) Prior Publication Data

US 2011/0206499 A1 Aug. 25, 2011

(30) Foreign Application Priority Data

Feb. 24, 2010 (JP) ..... 2010-038126

(51) Int. Cl.

| | |
|---|---|
| ***F04D 27/02*** | (2006.01) |
| ***F04D 29/42*** | (2006.01) |
| ***F04D 29/66*** | (2006.01) |
| ***F04D 1/06*** | (2006.01) |
| ***F04D 29/44*** | (2006.01) |
| ***F04D 29/62*** | (2006.01) |

(52) U.S. Cl.

CPC ..... *F04D 1/063* (2013.01); *F04D 29/426* (2013.01); *F04D 29/445* (2013.01); *F04D 29/628* (2013.01)

USPC ..... 415/1; 415/108; 415/182.1; 415/201; 415/199.1; 415/226

(58) Field of Classification Search

USPC ..... 415/182.1, 108, 201, 198.1, 199.1, 226, 415/190

See application file for complete search history.

(56) References Cited

U.S. PATENT DOCUMENTS 1,675,830 A * 7/1928 Spillmann et al. ..... 415/104
RE19,826 E * 1/1936 Aisenstein ..... 415/108

(Continued)

FOREIGN PATENT DOCUMENTS

JP 56-34997 4/1981
JP 62-180691 11/1987

(Continued)

OTHER PUBLICATIONS

International Search Report issued Dec. 21, 2010 in International (PCT) Application No. PCT/JP2010/067424.

(Continued)

*Primary Examiner* — Ned Landrum
*Assistant Examiner* — Aaron Jagoda
(74) *Attorney, Agent, or Firm* — Wenderoth, Lind & Ponack, L.L.P.

(57) ABSTRACT

A double casing type pump and a performance adjusting method allow for adjustment of the performance of the pump, especially the head of the pump, without large-scale work or component disassembly. The pump includes impellers fixed to a rotation shaft, an inner casing shrouding the impellers, an outer casing shrouding the inner casing and having a suction opening and a discharge opening. A space is formed between the inner and outer casings that communicates with the discharge opening. A bypass hole connects the space to the working fluid passage in the inner casing and has a throat diameter adjusting member. A plurality of throat diameter adjusting members are prepared in advance, each member having different throat area. One of the throat diameter adjusting members is selected so that the performance of the pump remains within a predetermined range.

12 Claims, 3 Drawing Sheets

(56) References Cited

U.S. PATENT DOCUMENTS

| | | | | | |
|---|---|---|---|---|---|
| 2,601,828 | A | * | 7/1952 | Lobanoff | 415/100 |
| 3,801,217 | A | * | 4/1974 | Ryall et al. | 415/199.2 |
| 4,311,161 | A | | 1/1982 | Narumi et al. | |
| 4,579,509 | A | * | 4/1986 | Jacobi | 415/199.1 |
| 4,778,334 | A | | 10/1988 | Medgyesy et al. | |
| 4,830,584 | A | * | 5/1989 | Mohn | 417/356 |

FOREIGN PATENT DOCUMENTS

| | | |
|---|---|---|
| JP | 2007-051592 | 3/2007 |
| JP | 4275997 | 6/2009 |

OTHER PUBLICATIONS

International Preliminary Report on Patentability and Written Opinion of the International Searching Authority issued Sep. 7, 2012 in International (PCT) Application No. PCT/JP2010/067424 w/English translation.

Japanese Decision to Grant a Patent issued Apr. 3, 2013 in corresponding Japanese Patent Application No. 2010-038126 with English translation.

* cited by examiner

DOUBLE CASING TYPE PUMP AND PERFORMANCE ADJUSTING METHOD THEREOF

BACKGROUND OF THE INVENTION

1. Field of the Invention

The present invention relates to a double casing type pump provided with: a rotation shaft; at least two impellers provided on the rotation shaft; an inner casing shrouding the impellers; an outer casing shrouding the inner cover and having a suction opening and a discharging opening regarding the working fluid of the pump. The present invention also relates to a performance adjusting method regarding the double casing type pump.

2. Background of the Invention

In recent years, the need for double casing type pumps and the head adjusting method thereof is increasing, the pump being provided with: a rotation shaft; at least two impellers provided on the rotation shaft; an inner casing shrouding the impellers; an outer casing shrouding the inner cover and having a suction opening and a discharging opening regarding the working fluid of the pump.

In a case where the rotation speed of the pump is constant, providing an opening-adjustable control valve (a control valve which opening is adjustable) on the fluid discharge line of the pump is well known as a method for adjusting the performance of the pump. However, according to this method, providing the control valve on the fluid discharge line causes a pressure drop and the deterioration of the pump efficiency. In this regard, the need for a feasible method for adjusting the performance of the pump other than the above-described method (providing the opening-adjustable control valve) is increasing.

Conventionally, in adjusting or modifying the pump performance, the adjustment of the outer diameter or the geometry of the impellers, the correction of the volute fluid-passage of impellers, or the modification of the shape of the volute fluid-passage is performed.

However, in performing each of the adjustment of the outer diameter or the geometry of the impeller, the correction of the volute fluid-passage and the modification of the volute fluid-passage, it becomes necessary to disassemble the pump, replace the impellers or the inner casing, or re-machine the impellers or the inner casing. Thus, the performance adjustment after the completion of the pump accompanies large-scale disassembling and re-assembling work; the performance adjustment needs a considerably large amount of hours and costs. In a case where the performance adjustment is performed particularly at the site after commissioning, it is often difficult to re-machine the impellers or the inner casing disassembled at the site; thus, it often becomes necessary to replace the components by substitute ones at the site. Hence, the performance adjustment often needs a huge amount of hours and costs particularly at the site.

Further, in performing the performance adjustment of the pump, when the impeller is replaced or re-machined and the whole balance of the rotor is reconditioned, then re-examining the vibrations of the reconditioned rotor is required; thus, a huge amount of hours and cost becomes necessary for the re-examination as to the rotor vibrations.

Further, when the rotor reconditioning is performed so as to adjust the pump performance, a possibility arises where each pump has different rotor geometry. Thus, the interchangeability regarding the components is lost between a component of a pump and the corresponding component of another pump that is manufactured as a same type pump in a series-production.

In the background as described above, as a technology that eases the pump performance adjustment, the patent reference 1 discloses a pump having an impeller provided with a plurality of main impeller vanes; whereby, an additional vane is provided between the back side (i.e. belly surface side) of a main impeller vane and the front side (i.e. back surface side) of the adjacent main impeller vane; the additional blade is extended from a point on the back side surface of the impeller vane toward the front side surface of the adjacent impeller vane. According to this disclosed technology, the pump performance curve of the pump can be easily adjusted thanks to the impeller with the additional vanes.

Further, the patent reference 2 discloses a technology regarding a power steering apparatus; thereby, the pressurized fluid discharged from the pump is sent to a power steering apparatus via a throttle passage; by returning a surplus fluid flow to the suction side of the pump by use of a flow rate control valve that controls the degree of the opening regarding a by-pass passage through which the surplus fluid flow returns to the suction side.

REFERENCES

Patent References

Patent Reference 1: JP2007-051592
Patent Reference 2: JP1981-34997

SUMMARY OF THE INVENTION

In the technology as disclosed in the patent reference 1, however, disassembling the pump for the pump performance adjustment and re-examining the rotor vibration after the adjustment work cannot be omitted.

Further, the technology disclosed in the patent reference 2 does not relate to the performance adjustment as to the pump itself; even the technology of the patent reference 2 cannot be applied to the performance adjustment as to the pump itself.

In view of the problems of the conventional technologies as described above, the present invention aims at providing a double casing type pump and a performance adjusting method thereof, the pump being provided with: a plurality of impellers fixed to a rotation shaft (a rotor shaft), an inner casing shrouding the impellers; an outer casing shrouding the inner casing and having a suction opening and a discharge opening; wherein, the performance of the pump, especially, the head of the pump is able to be adjusted without large-scale work as well as without component disassembly.

In order to solve the problems, the present invention discloses a double casing type pump provided with a plurality of impellers fixed to a rotation shaft, an inner casing shrouding the impellers, and an outer casing shrouding the inner casing and having a suction opening and a discharge opening for fluid; wherein, the pump comprises:

a space formed between the inner casing and the outer casing, and communicating with the discharge opening; and a bypass hole connecting the space to a working fluid passage in the inner casing, the pressure in the working fluid passage being lower than the fluid stagnating in the space; further wherein, the bypass hole comprises a throat diameter adjusting member having a through-hole therein for determining (or adjusting) the throat area of the bypass hole.

Incidentally, as the throat diameter adjusting member, a bush or an orifice may be used; this point will be described later.

As described above, the stagnant fluid flow in the space formed between the inner casing and the outer casing partly joins the fluid flow in the working fluid passage in the inner casing, through the through-hole in the throat diameter adjusting member provided in the bypass hole, the pressure in the working fluid passage being lower than the stagnant fluid flow in the space between the inner casing and the outer casing; in addition, owing to the pressure difference, the fluid flow confluence is performed.

Hereby, the fluid stagnating in the space is the higher pressure fluid pressurized by the double casing type pump; and, the lower pressure fluid in the working fluid passage is further pressurized afterward. In other words, according to the present invention, a part of the fluid pressurized by the double casing type pump returns back to the inside of the pump on a part way of the pressurizing process at the upstream side; thus, a circulatory flow is realized. In this way, even when the flow rate of the fluid suctioned into the pump is kept constant and balanced with the flow rate of the fluid delivered out of the pump, a fluid flow which flow rate is greater than the balanced (rated) flow rate by the circulatory flow rate is formed inside of the double casing type pump; the fluid flow of the greater flow rate passes through some impellers out of the multiple impellers. In this way, even when the flow rate of the fluid suctioned into the pump is kept constant and balanced with the flow rate of the fluid delivered out of the pump, the flow rate of the fluid which passes through the some impellers out of the whole multiple impellers can be changed; thus, the performance of the pump can be changed. Accordingly, the performance of the pump can be easily adjusted.

Further, a preferable embodiment according to the present invention is the double casing type pump, wherein the throat diameter adjusting member is a one selected from a plurality of throat diameter adjusting members each of which having different throat area in order that the performance of the pump remains within a predetermined range.

As described above, by previously preparing a plurality of throat diameter adjusting members in such a way that each throat diameter adjusting member comprises its own diameter regarding the through-hole in each member (as well as by installing one of the prepared members), the performance of the pump 1 can be adjusted so as remain within the predetermined range. Accordingly, the performance of the pump can be easily adjusted.

Another preferable embodiment is the double casing type pump, wherein the bypass hole is arranged in a place where the throat diameter adjusting members are detachable from the outside of the pump.

In this way, the replacement of the throat diameter adjusting member can be easily performed from the outside of the pump; thus, in a simple manner as well as in a short time, the performance of the pump can be easily adjusted without disassembling the pump.

Another preferable embodiment is the double casing type pump, wherein the impellers of the pump form a downstream side runner group and an upstream side runner group, each runner group comprising the impellers in multistage, each runner group being fixed to the rotation shaft;

the inner casing is provided with an intermediate fluid passage through which the fluid pressurized by passing through the upstream side runner group is sent to the downstream side runner group;

the bypass hole connects the space formed between the inner casing and the outer casing to the intermediate fluid passage.

A pump provided with multistage impellers is used generally for pressurizing the working fluid to a certain high pressure level. Hence, when the communication of the bypass hole with the space formed between the inner casing and the outer casing as well as the place where the fluid is not pressurized at all, then the pressure difference between the back and forth positions of the bypass hole becomes so great that the pump head too remarkably changes with a slight change of the diameter of the through-hole in the throat diameter adjusting member provided in the bypass hole. In order to restrain the sensitivity (regarding the pump head) due to the diameter change, in the present invention, the bypass hole connects the space formed between the inner casing and the outer casing to the intermediate fluid passage; since the fluid in the intermediate fluid passage is already pressurized at least one stage of multistage impellers, the pressure difference between the back and forth positions of the bypass hole can be restrained under a certain low level. Thus, it can be realized that a slight change of the diameter of the through-hole in the throat diameter adjusting member does not cause an excessive change in the pump head.

Another preferable embodiment is the double casing type pump, whereby the multiple throat diameter adjusting members are a plurality of bushes, each bush having a through-hole of an inner diameter different from the inner diameter of the through-hole of another bush.

In this way, only by fitting the bush (throat diameter adjusting member) into the bypass hole and extracting the bush from the bypass hole, the bush can be attached to and detached from the pump. Accordingly, the insertion and withdrawal of the bush can be easily performed.

Further, the present invention discloses a method for adjusting the performance of a double casing type pump, the pump provided with a plurality of impellers fixed to a rotation shaft, an inner casing shrouding the impellers, and an outer casing shrouding the inner casing and having a suction opening and a discharge opening for fluid; wherein, the pump further comprises:

a space formed between the inner casing and the outer casing; and a bypass hole connecting the space to a working fluid passage in the inner casing, the pressure in the working fluid passage being lower than the fluid stagnating in the space; wherein, the communication hole is provided with a throat diameter adjusting member which is selected from a plurality of throat diameter adjusting members each of which having different throat area in order that the performance of the pump remains within a predetermined range.

Effects of the Invention

The present invention can provide a double casing type pump and a performance adjusting method thereof, the pump being provided with: a plurality of impellers fixed to a rotation shaft (a rotor shaft), an inner casing shrouding the impellers; an outer casing shrouding the inner casing and having a suction opening and a discharge opening; wherein, the performance of the pump, especially, the head of the pump is able to be adjusted without large-scale work as well as without component disassembly.

BRIEF DESCRIPTION OF THE DRAWINGS

The present invention will now be described in greater detail with reference to the preferred embodiments of the invention and the accompanying drawings, wherein.

DETAILED DESCRIPTION OF THE INVENTION

Hereafter, the present invention will be described in detail with reference to the embodiments shown in the figures. However, the dimensions, materials, shape, the relative placement and so on of a component described in these embodiments shall not be construed as limiting the scope of the invention thereto, unless especially specific mention is made.

Embodiment

Figure 1:
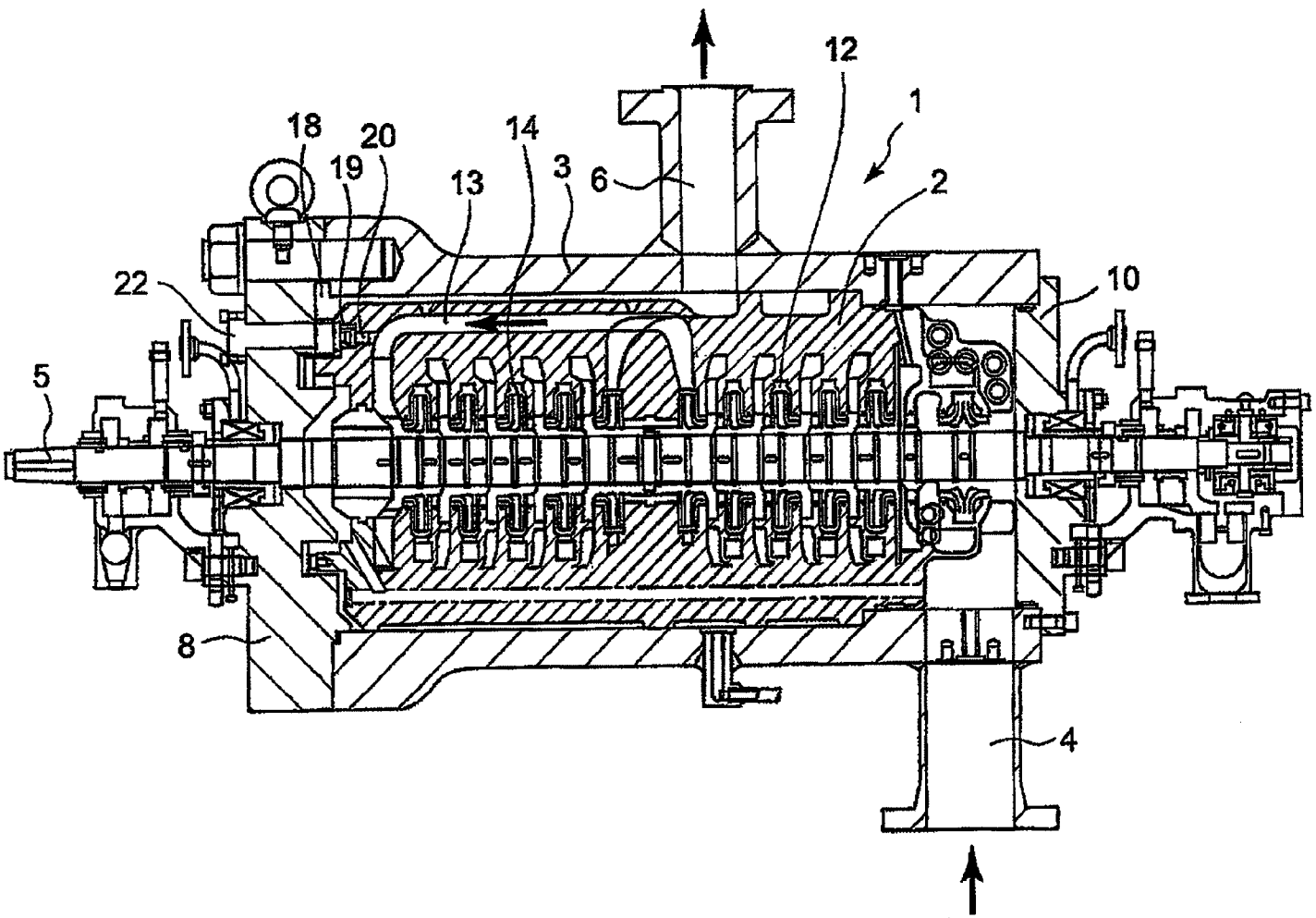
FIG. 1 shows a cross-section of a double casing type pump according to an embodiment of the present invention.

FIG. 1 shows a cross-section of a double casing type pump according to an embodiment of the present invention. At first, the whole configuration as to the double casing type pump according to the embodiment is now be explained on the basis of FIG. 1.

The double casing type pump 1 is provided with: a first runner group 12 comprising multistage impellers (6 stage impellers in FIG. 1); a second runner group 14 comprising multistage impellers (5 stage impellers in FIG. 1); an inner casing 2 shrouding the first runner group 12 and the second runner group 14; an outer casing 3 shrouding the inner casing 2; a cover 8 sealing the opening at an end of the outer casing 3; a cover 10 sealing the opening at another end of the outer casing 3. Further, the first runner group 12 and the second runner group 14 are fixed to a shaft 5, each runner group comprising a plurality of impellers of a multistage.

The outer casing 3 is provided with a suction opening and a discharge opening 6. Further, a space 18 communicating with the discharge opening 6 is formed between the inner casing 2 and the outer casing 3.

Further, in the inner casing 2, a crossover 13 (i.e. an inner casing crossover passage 13) is provided, the crossover 13 being an intermediate passage of the fluid that is pressurized by the first runner group 12 and delivered to the second runner group 14.

Further, in the inner casing 2, a bypass hole 19 is provided, the bypass hole 19 connecting the space 18 to the crossover 13; in the bypass hole 19, a bush 20 is inserted and fixed therein so that the bush 20 has a penetrating hole not to completely clog the fluid flow. In other words, the bypass hole 19 in the inner casing 2 is arranged so that a flow direction from the space 18 to the crossover 13 is formed.

Figure 2:
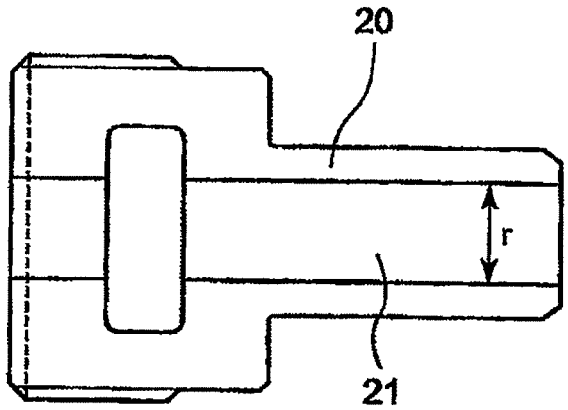
FIG. 2 shows an outline of a bush.

FIG. 2 shows an outline of the bush 20; as shown in FIG. 2, a through-hole 21 of a diameter r is provided in the bush 20.

Further, in the cover 8, a cylindrical bypass hole is provided so that the hole connects the space 18 to the outside of the pump 1; when the pump is assembled, a bush replacing cover 22 for replacing the bush 20 is inserted into the cylindrical bypass hole so that the bush replacing cover 22 clogs the cylindrical bypass hole. Incidentally, the bush replacing cover 22 is fastened to the cover 8 by use of a plurality of fasteners such as bolts; and, the bush replacing cover 22 is arranged so as to be detachable from the cover 8, when the fasteners such as bolts are removed. Further, the bush 20 is located on the extension line of the longitudinal (center) line of the bypass hole in the inner casing 2; incidentally, the cylindrical bypass hole is provided for inserting the bush replacing cover 22 into the cylindrical bypass hole in the cover 8.

In the next place, the working principle of the double casing type pump 1 as described above is now explained.

When the rotation shaft 5 is driven, the runner groups 12 and 14 are rotated. And, the to-be-pressurized fluid such as water is guided into the first runner group 12 comprising multistage impellers (6 stage impellers in FIG. 1) via the suction opening 4; then, the fluid is guided into each stage impeller of the first runner group 12, in order; and, each stage impeller pressurizes the fluid. In the next place, the fluid pressurized by the first runner group 12 is guided into the second runner group 14; then, the fluid is guided into each stage impeller of the second runner group 14, in order; and, each stage impeller pressurizes the fluid. Further, the fluid pressurized by the second runner group 14 is mainly delivered outside of the pump through the discharge opening 6, and partly returned back to the crossover 13 through the through-hole 21 in the bush 20 provided in the bypass hole 19, via the space 18 formed between the inner casing 2 and the outer casing 3. The fluid streaming in the space 18 is the fluid that is pressurized in the second runner group 14; the pressure level of the fluid in the space 18 is higher than the pressure level of the fluid in the crossover 13; the fluid in the crossover 13 is the working fluid before being pressurized by the second runner group 14. Hence, thanks to the pressure difference, the fluid in the space 18 streams into the crossover 13.

According to the working principle as described above, owing to the difference between the pressure in the space 18 and the pressure in the crossover, the fluid flow in the space 18 formed between the inner casing 2 and the outer casing 3 partly joins the fluid flow in the crossover 13 through the through-hole 21 in the bush 20 provided in the bypass hole 19. Thus, even when the flow rate of the fluid suctioned into the pump 1 is kept constant and balanced with the flow rate of the fluid delivered out of the pump 1, a circulatory flow with a flow rate greater than the constantly balanced flow rate can be formed so that the circulatory flow travels around a route passing through the crossover 13, the second runner group 14 and the space 18 in order, and returning to the crossover 13. In this manner, even when the flow rate of the fluid suctioned into the pump 1 and the flow rate of the fluid delivered out of the pump 1 is kept constant, the work done by the second runner group can be changed; namely, by providing the bypass hole 19 and the bush 20, the head of the pump can be changed.

In the next place, the adjustment method for adjusting the head of the double casing type pump 1 together with the steps thereof is now explained.

In a case where the head of the double casing type pump 1 is adjusted, the operation of the pump 1 is stopped, at first; after the fluid in the pump 1 is thoroughly removed, the bush replacing cover 22 is detached from the cover 8.

In the next place, after the bush replacing cover 22 is detached, the bush 20 is removed from the bypass hole 19, by use of a removing tool (or an extracting tool); then, the bush 20 is replaced by another bush 20 that is selected out of a plurality of bushes prepared in advance, each bush having its own diameter r regarding the through-hole in the bush so that the head of the pump remains within a predetermined range with a selected bush.

In replacing the bush 20, it is preferable that the effect (or effectiveness) of each bush (that has its own diameter r regarding the through-hole) on the pump head is previously estimated by calculations or experiment-based measurements.

In the next place, the bush replacing cover 22 is fastened to the cover 8; then, the operation of the pump 1 is performed; thereby, the actual head of the pump 1 is measured so as to confirm whether or not the actual head remains within the predetermined range with the selected bush. When the measured head is within the predetermined range, the performance adjustment is finished; when the measured head is out of the predetermined range, the operation of the double casing type pump 1 is stopped and the bush 20 is replaced by another one according the steps as described above. Thus, the performance adjustment is repeated until the measured head remains within the predetermined range.

By replacing the bush 20 and changing the head of the double casing type pump 1 so as to select a suitable bush, the head of the pump 1 can be adjusted; by previously preparing a plurality of bushes so that each bush has its own diameter r (in FIG. 2) regarding the through-hole in each bush (as well as by installing one of bushes), the head of the pump 1 can be adjusted so as remain within the predetermined range. In this manner, the adjustment regarding the head of the pump can be easily performed. Thus, the head of the pump can be easily adjusted.

In addition, in the embodiment as described above, a single bypass hole 19 is provided; a plurality of bypass holes may be provided so that each bypass hole can be provided with a bush 20; and, the fine adjustment of the head can be performed.

Further, the bush 20 is located on the extension line of the longitudinal (center) line of the (cylindrical) bypass hole in the cover 8, the (cylindrical) bypass hole being provided for inserting the bush replacing cover 22 into the (cylindrical) bypass hole in the cover 8. By detaching the bush replacing cover 22 from the pump 1 (or the cover 8), the replacement of the bush 20 can be easily performed from the outside of the pump. Thus, in a simple manner as well as in a short time, the head of the pump can be easily adjusted without disassembling the pump.

Further, the bypass hole 19 in which the bush 20 is fitted bypass holes with the space 18 as well as the crossover 13. The pump provided with a group of multistage impellers as shown in FIG. 1 is usually used for pressurizing the fluid to a high pressure level. Thereby, the bypass hole 19*b* communicates with the space 18 as well as the crossover 13; the pressure level of the fluid in the crossover 13 reaches a certain pressure level (an intermediate level against the rated pressure). Accordingly, an excessive pressure difference between the back and forth positions of the bypass hole (i.e. between the space 18 and the crossover) can be prevented from occurring; namely, a slight change of the diameter of the through-hole 21 in the bush 20 does not cause an excessive change in the pump head.

Comparative Example

Figure 3:
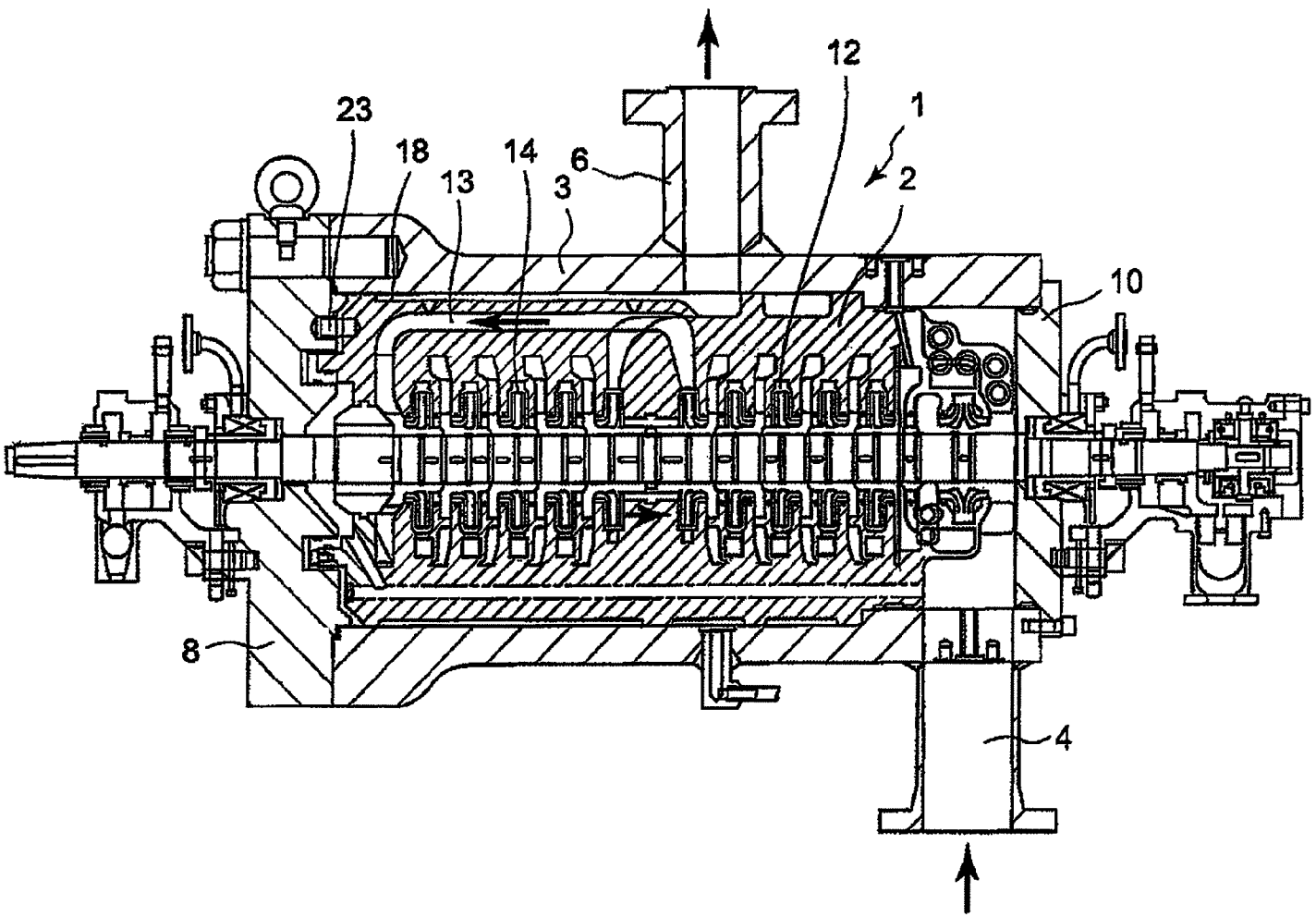
FIG. 3 shows a cross-section of a double casing type pump as a comparison example according to the conventional technology.

FIG. 3 shows a cross-section of a double casing type pump as a comparison example; namely, FIG. 3 relates to a conventional technology.

The same numeral in FIG. 3 as in FIG. 1 denotes the same component; the explanation as to the same component is omitted.

The double casing type pump according to the comparison example is different from the double casing type pump 1 according to the embodiment of the present invention, in that the former pump does not have the bypass hole 19, the bush 20 and the bush replacing cover 22 as well as in that the former pump has a pin 23 (e.g. a dowel pin) between the inner casing 2 and the cover 8.

In the comparison example, the fluid stagnating in the space 18 that communicates with the discharge opening 6 does not return back to the crossover 13; the fluid in the space 18 stagnates in the space 18 or is delivered outside of the pump through the discharge opening 6. Accordingly, it is impossible to adjust the flow rate of the fluid guided into the second runner group. Thus, in adjusting the head of the pump according to the comparison example, as is the case with the conventional practices, it is required that the component such as the first runner group 12, the second runner group 14 or the inner casing 2 be dismantled and re-machined or replaced by corresponding substitute component.

Industrial Applicability

The present invention can provide a double casing type pump and a head adjusting method thereof, the pump being provided with: a plurality of impellers fixed to a rotation shaft (a rotor shaft), an inner casing that shrouding the impellers; an outer casing shrouding the inner casing and having a suction opening and a discharge opening; wherein, the performance of the pump, especially, the head of the pump is able to be adjusted without large-scale work as well as without component disassembly.

The invention claimed is:

1. A double casing type pump comprising:
- a plurality of impellers fixed to a rotation shaft;
- an inner casing shrouding the impellers;
- a throat diameter adjusting member;
- a replacing cover; and
- an outer casing forming at least a part of an outer housing of the double casing type pump, the outer casing shrouding the inner casing and having a suction opening and a discharge opening for fluid, wherein
- the inner casing and the outer casing have a space formed therebetween that communicates with the discharge opening,
- the inner casing has a working fluid passage configured to direct the fluid having a pressure that is lower than the fluid inside the space to a downstream side of the double casing type pump,
- the inner casing has a bypass hole that connects the space and the working fluid passage inside the inner casing,
- the throat diameter adjusting member is attached to the bypass hole, has a through-hole that defines a throat diameter of the bypass hole, and is configured to allow a return flow from the discharge opening to the working fluid passage via the space and the through-hole,
- the outer housing has a communication hole that communicates between the space and outside of the double casing type pump,
- the replacing cover is detachably attached to the communication hole to block the communication hole, and
- the throat diameter adjusting member is configured to be replaceable from the outside of the double casing type pump via the communication hole when the replacing cover is detached from the communication hole.

2. The double casing type pump according to claim 1, wherein
- the throat diameter adjusting member is one selected from a plurality of throat diameter adjusting members each of which has a different throat area such that performance of the double casing type pump remains within a predetermined range.

3. The double casing type pump according to claim 2, wherein the plurality of throat diameter adjusting members are a plurality of bushes, each of the bushes having a through-hole with an inner diameter different from the inner diameter of the through-hole of another of the bushes.

4. The double casing type pump according to claim 2, wherein the impellers form a downstream side runner group and an upstream side runner group, each of the downstream side and upstream side runner groups comprising the impellers in a multistage configuration, each of the downstream side and upstream side runner groups being fixed to the rotation shaft, and the fluid pressurized by passing through the upstream side runner group is sent to the downstream side runner group through the working fluid passage inside the inner casing.

5. The double casing type pump according to claim 1, wherein the impellers form a downstream side runner group and an upstream side runner group, each of the downstream side and upstream side runner groups comprising the impellers in a multistage configuration, each of the downstream side and upstream side runner groups being fixed to the rotation shaft, and the fluid pressurized by passing through the upstream side runner group is sent to the downstream side runner group through the working fluid passage inside the inner casing.

6. The double casing type pump according to claim 1, wherein the impellers form a downstream side runner group and an upstream side runner group, each of the downstream side and upstream side runner groups comprising the impellers in a multistage configuration, each of the downstream side and upstream side runner groups being fixed to the rotation shaft, and the fluid pressurized by passing through the upstream side runner group is sent to the downstream side runner group through the working fluid passage inside the inner casing.

7. The double casing type pump according to claim 1, wherein the throat diameter adjusting member is configured to allow the return flow due to a pressure difference between the space and the working fluid passage in any circumstance where the double casing type pump is in operation.

8. The double casing type pump according to claim 1, wherein the throat diameter adjusting member is disposed on an extension line of a longitudinal line of the communication hole.

9. The double casing type pump according to claim 1, wherein the outer housing further comprises an end cover disposed at an end of the outer casing, and the communication hole of the outer housing is provided in the end cover.

10. A method for adjusting performance of a double casing type pump, the double casing type pump including:

a plurality of impellers fixed to a rotation shaft;

an inner casing shrouding the impellers, the inner casing having a working fluid passage;

an outer casing forming at least a part of an outer housing of the double casing type pump, the outer casing shrouding the inner casing and having a suction opening and a discharge opening for fluid;

a throat diameter adjusting member; and a replacing cover, wherein the inner casing and the outer casing have a space formed therebetween, the inner casing has a bypass hole that connects the space to the working fluid passage in the inner casing, the throat diameter adjusting member is attached to the bypass hole, has a through-hole that defines a throat diameter of the bypass hole, and is configured to allow a return flow from the discharge opening to the working fluid passage via the space and the through-hole, the outer housing has a communication hole that communicates between the space and outside of the double casing type pump, and the replacing cover is detachably attached to the communication hole to block the communication hole, the method comprising:

detaching the replacing cover from the communication hole;

replacing the throat diameter adjusting member from the outside of the double casing type pump via the communication hole;

attaching the replacing cover to the communication hole; and establishing the return flow due to a pressure difference between the space and the working fluid passage so as to adjust the performance of the double casing type pump.

11. The method according to claim 10, further comprising:

measuring the performance of the double casing type pump in a state where the return flow is established; and confirming whether or not the measured performance of the double casing type pump is within a predetermined range.

12. A method for adjusting performance of a double casing type pump, the double casing type pump including:

a plurality of impellers fixed to a rotation shaft;

an inner casing shrouding the impellers, the inner casing having a working fluid passage;

an outer casing shrouding the inner casing and having a suction opening and a discharge opening for fluid, wherein the inner casing and the outer casing have a space formed therebetween, and a bypass hole connects the space to the working fluid passage in the inner casing, the method comprising:

attaching to the bypass hole a throat diameter adjusting member having a through-hole that defines a throat diameter of the bypass hole, and being configured to allow a return flow from the discharge opening to the working fluid passage via the space and the through-hole;

establishing the return flow due to a pressure difference between the space and the working fluid passage so as to adjust the performance of the double casing type pump;

measuring the performance of the double casing type pump in a state where the return flow is established;

confirming whether or not the measured performance of the double casing type pump is within a predetermined range; and replacing the throat diameter adjusting member with another throat diameter adjusting member having a through-hole whose size is different from the through-hole of the replaced throat diameter adjusting member.

* * * * *